US006857511B2

(12) United States Patent
Lin et al.

(10) Patent No.: US 6,857,511 B2
(45) Date of Patent: Feb. 22, 2005

(54) SINGLE HANDLE ROD BASED RETRACTABLE HANDLE ASSEMBLY FOR WHEELED LUGGAGE

(75) Inventors: Jer Hong Lin, Taipei (TW); Shih Yu Chang, Taipei (TW); Chung-Hsien Kuo, Pan-Chiao (TW); Chia Hsien Lin, Taipei (TW)

(73) Assignee: Chaw Khong Technology Co., Ltd., Taipei (TW)

( * ) Notice: Subject to any disclaimer, the term of this patent is extended or adjusted under 35 U.S.C. 154(b) by 0 days.

(21) Appl. No.: 10/288,422

(22) Filed: Nov. 6, 2002

(65) Prior Publication Data

US 2003/0085089 A1 May 8, 2003

(30) Foreign Application Priority Data

Nov. 8, 2001 (TW) ..... 90219239 U

(51) Int. Cl.[7] ..... A45C 5/14; A45C 13/26

(52) U.S. Cl. ..... 190/115; 190/18 A; 190/39; 16/113.1

(58) Field of Search ..... 190/18 A, 39, 190/115; 16/113.1, 114.1

(56) References Cited

U.S. PATENT DOCUMENTS

| | | | | | |
|---|---|---|---|---|---|
| 2,784,816 | A | * | 3/1957 | Goldberg | 190/115 |
| 4,538,709 | A | * | 9/1985 | Williams et al. | 190/18 A |
| 4,550,813 | A | * | 11/1985 | Browning | 190/18 A |
| 5,048,649 | A | * | 9/1991 | Carpenter et al. | 190/18 A |
| 5,075,925 | A | * | 12/1991 | Maloney | 16/113.1 |
| 5,249,438 | A | * | 10/1993 | Rhaney et al. | 62/457.7 |
| 5,265,307 | A | * | 11/1993 | Hull et al. | 16/406 |
| 5,339,934 | A | * | 8/1994 | Liang | 190/18 A |
| 5,343,988 | A | * | 9/1994 | Bartsch et al. | 190/18 A |
| 5,370,409 | A | * | 12/1994 | Latouche | 280/47.26 |
| 5,464,080 | A | * | 11/1995 | Liang | 190/18 A |
| 5,564,538 | A | * | 10/1996 | Sadow | 190/18 A |
| 5,689,854 | A | * | 11/1997 | Wang | 16/113.1 |
| 5,690,196 | A | * | 11/1997 | Wang | 190/115 |
| 5,890,570 | A | * | 4/1999 | Sadow | 190/18 A |
| 6,122,800 | A | * | 9/2000 | Cheng | 16/113.1 |
| 6,193,033 | B1 | * | 2/2001 | Sadow et al. | 190/18 A |
| 6,279,706 | B1 | * | 8/2001 | Mao | 190/115 |
| 6,301,746 | B1 | * | 10/2001 | Myers et al. | 16/113.1 |
| 6,317,924 | B1 | * | 11/2001 | Gallagher | 16/114.1 |
| 6,409,207 | B1 | * | 6/2002 | Kuo | 280/655.1 |
| 6,434,790 | B1 | * | 8/2002 | Chen | 16/113.1 |
| 6,508,344 | B1 | * | 1/2003 | Lu | 190/115 |
| 6,530,459 | B1 | * | 3/2003 | Lu | 190/115 |
| 6,591,951 | B1 | * | 7/2003 | Chen | 190/115 |
| 2002/0050429 | A1 | * | 5/2002 | Nykoluk et al. | |
| 2003/0000785 | A1 | * | 1/2003 | Miller et al. | |
| 2003/0132079 | A1 | * | 7/2003 | Bellini | |
| 2003/0132080 | A1 | * | 7/2003 | Dababneh | |

FOREIGN PATENT DOCUMENTS

| | | | | |
|---|---|---|---|---|
| CA | 2287720 | * | 4/2000 | A45C/13/26 |
| DE | 3636064 | * | 4/1988 | A45C/05/14 |
| FR | 2661807 A1 | * | 11/1991 | A45C/13/26 |

* cited by examiner

*Primary Examiner*—Sue A. Weaver
(74) *Attorney, Agent, or Firm*—Troxell Law Office PLLC

(57) ABSTRACT

A retractable handle assembly of luggage comprises a single handle rod extended upward from a center at a joining edge of a top and a rear of luggage and having an upper portion and a lower portion connected to the rear; and a handle grip extended at a predetermined range of angle about a horizontal plane from a top of the handle rod toward a side of the luggage being perpendicular to the top or the rear of luggage in a stand-up position. An orientation of a hand holding the handle grip is parallel to a moving direction of the luggage being towed for facilitating an exertion of user's force thereon, thereby lowering a center of gravity of luggage for saving labor.

8 Claims, 14 Drawing Sheets

SINGLE HANDLE ROD BASED RETRACTABLE HANDLE ASSEMBLY FOR WHEELED LUGGAGE

BACKGROUND OF THE INVENTION

1. Field of the Invention

The present invention relates to wheeled luggage and more particularly to a single handle rod based retractable handle assembly for wheeled luggage having a pivotal handle grip for being adapted to fit different individuals with various heights.

2. Description of Related Art

Conventionally, a handle assembly of wheeled luggage has a pair of parallel handle rods (typically, they are retractable) disposed on a rear of the luggage and a top handle grip interconnected the handle rods. Hence, a user can tow the luggage by holding the handle grip. This has the advantage of increased stability while towing luggage. However, it also consumes some precious storage space of luggage because a portion of rear is configured to receive the handle assembly. Further, more components (e.g., sliding tube(s), a support tube, and one or more associated locking devices) means higher possibility of fail of luggage and higher manufacturing cost. Hence, a handle assembly having a single handle rod has been developed. Such is best illustrated in FIGS. 19 and 20. For increasing the structural strength, a handle rod H typically has a larger diameter. However, the prior art is unsatisfactory for the purpose for which the invention is concerned for the following reasons: User may feel uncomfortable by holding both a T-shaped handle grip G and a joint C between the handle grip G and a handle rod H with fingers fully extended while towing the luggage with considerable force. This is particularly true if the towing is long in distance. Also, for the aesthetic purpose, both horizontal parts of the handle grip G are made short. As such, it is often that the user's trouser T may interfere with one wheel while towing luggage. In other words, the handle grip G does not extend laterally enough (i.e., it is near the center of luggage). It is quite inconvenient.

Moreover, in such single handle rod based retractable handle assembly an orientation of the hand holding handle grip is perpendicular to a moving direction of user while towing the luggage. This means that the hand is turned about 90 degrees. It is not ergonomic. In addition, an angle of handle grip with respect to handle rod is fixed since they are fixedly connected. Such has the disadvantage of impossible of adapting the handle grip to fit different individuals with various heights by pivoting the same. As a result, many users may bear a great burden while towing the luggage. In other words, it is not a labor saving design.

Thus, it is desirable to provide an improved single handle rod based retractable handle assembly for wheeled luggage in order to overcome the above drawbacks of the prior art.

SUMMARY OF THE INVENTION

It is an object of the present invention to provide a single handle rod based retractable handle assembly for wheeled luggage wherein an orientation of the hand holding the handle grip is parallel to a moving direction of user for facilitating an exertion of user's force while towing the luggage. This is ergonomic. Also, a pivot angle of the handle grip is adjustable to fit different individuals with various heights for saving labor.

It is another object of the present invention to provide a single handle rod based retractable handle assembly for wheeled luggage wherein the handle grip is rotatable either clockwise or counterclockwise to be either parallel or perpendicular to a straight line between wheels of the luggage for ease of being gripped by either hand which tows the luggage.

It is a further object of the present invention to provide a single handle rod based retractable handle assembly for wheeled luggage wherein the handle grip is rotatable either clockwise or counterclockwise to an angle of from about 0 degree to about 180 degrees with respect to a straight line between wheels of the luggage for ease of being gripped by either hand which tows the luggage.

To achieve the above and other objects, the present invention provides a retractable handle assembly of a luggage having wheels at both rear corners for moving the luggage, the handle assembly comprising a single handle rod extended upward from a center at a joining edge of a top and a rear of the luggage and having an upper portion and a lower portion connected to the rear, and a handle grip extended at a predetermined range of angle about a horizontal plane from a top of the handle rod toward either side of the luggage being perpendicular to a straight line between wheels in an unused position; whereby an orientation of a hand holding the handle grip is parallel to a moving direction of the luggage being towed for facilitating an exertion of force thereon, thereby lowering a center of gravity of the luggage for saving labor.

In one aspect of the present invention, the handle assembly further comprises a single handle rod extended upward from a center at a joining edge of a top and a rear of the luggage and having an upper portion and a lower portion connected to the rear; and a pivotal handle grip extended horizontally from a top of the handle rod toward the rear of the luggage wherein a pivot angle about a positioned first plane perpendicular to the handle rod is from 0 degree to 180 degrees; whereby an orientation of a hand holding the handle grip is parallel to the first plane direction of the luggage being towed for facilitating an exertion of force thereon, thereby lowering a center of gravity of the luggage for saving labor.

In another aspect of the present invention, wherein the handle grip extended horizontally from the top of the handle rod is operative to pivot an angle from 0 degree to 180 degrees about a second plane perpendicular to the first plane.

The above and other objects, features and advantages of the present invention will become apparent from the following detailed description taken with the accompanying drawings.

DETAILED DESCRIPTION OF THE PREFERRED EMBODIMENTS

Figure 1:
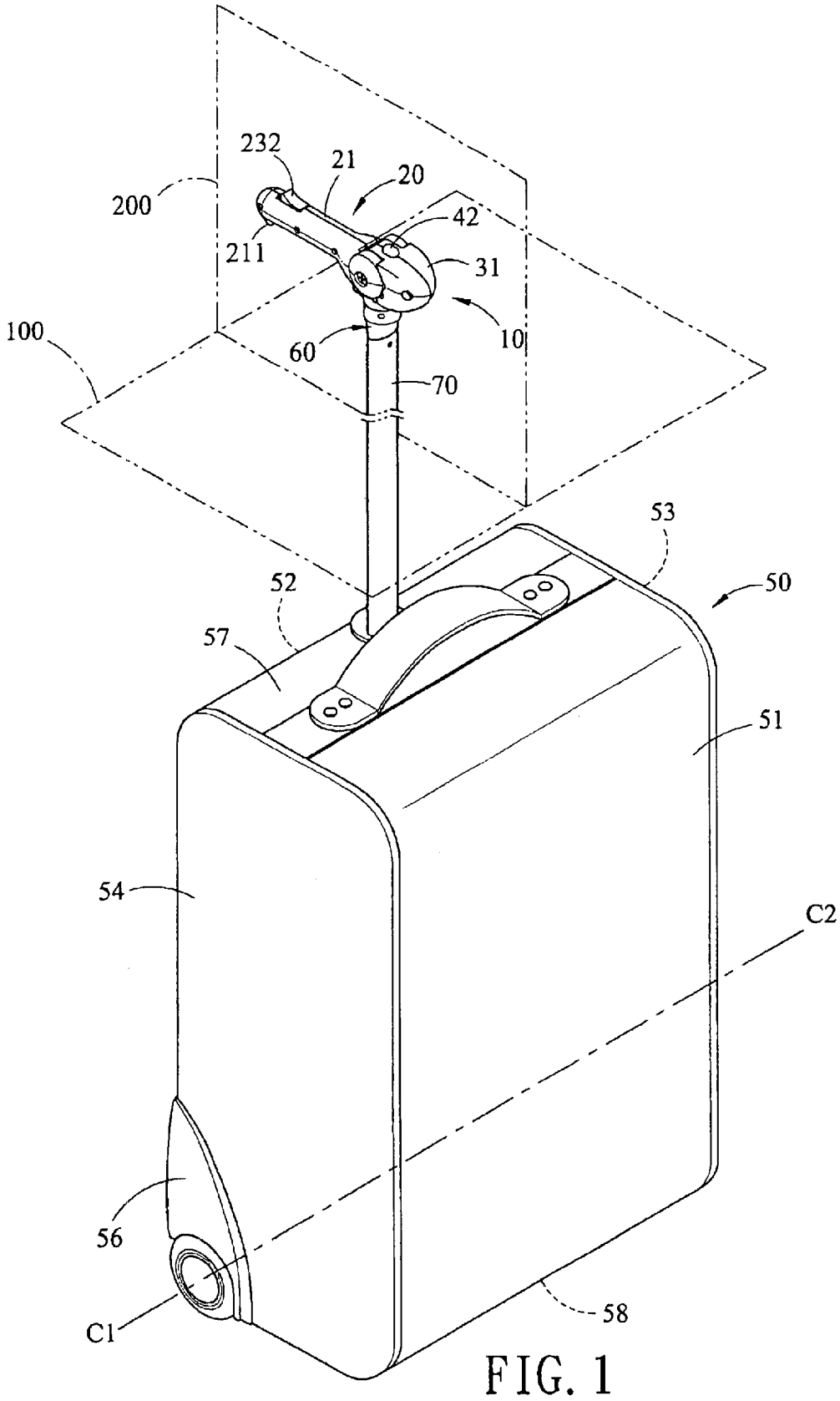
FIG. 1 is a perspective view of a first preferred embodiment of a single handle rod based retractable handle assembly mounted on a wheeled luggage according to the invention.
Figure 2A:
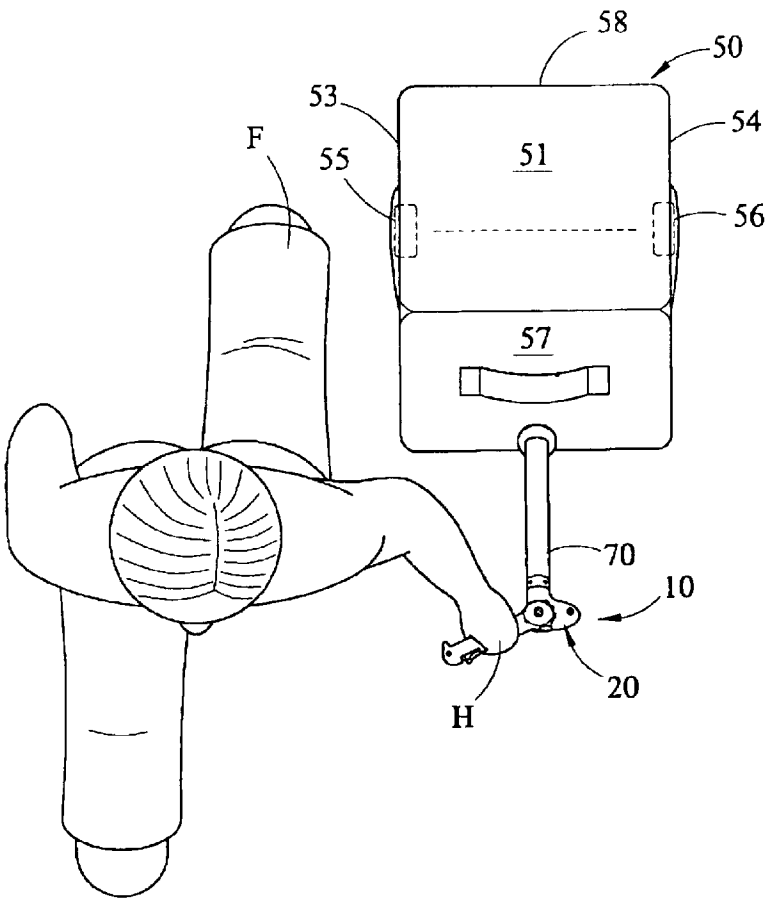
FIG. 2A is a view similar to FIG. 2 where the handle grip is pivoted.
Figure 2:
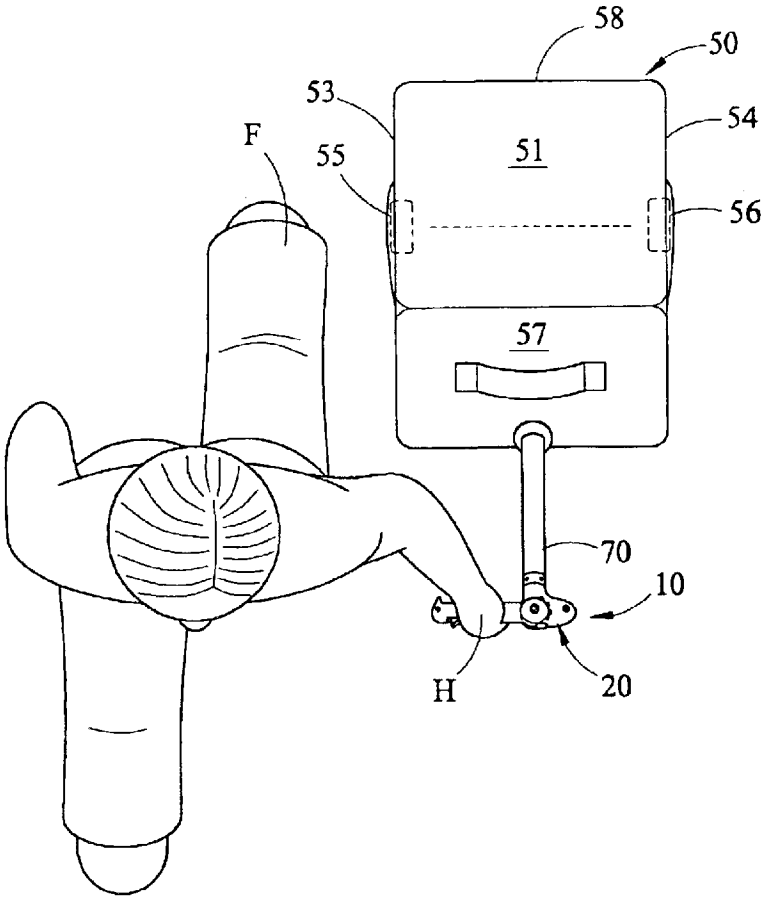
FIG. 2 is a top plan view showing the luggage of FIG. 1 being towed.

Referring to FIGS. 1 to 4, there is shown a wheeled luggage 50 constructed in accordance with a first preferred embodiment of the invention. The luggage 50 comprises a front 51, a rear 52, two sides 53 and 54, a top 57, a bottom 58, two wheels 55 and 56 for moving the luggage, and a single handle rod based retractable handle assembly 10. The handle assembly 10 is extended upward from a center at a joining edge of the top 57 and the rear 52. The handle assembly 10 is the subject of the invention and will be described in detail as follows. The handle assembly 10 comprises a handle rod 70 (i.e., first sliding tube) having an upper portion and a lower portion, a handle grip 20 extended horizontally from a top of the handle rod 70 (i.e., parallel to a center line C1-C2 of two wheels 55–56 the top 57, or the bottom 58) in a normal stand-up position wherein the horizontal extension length of the handle grip 20 is slightly smaller than a half of width of the top 57. Further, the handle grip 20 is equiangular pivotal. As shown in FIG. 2, in a case that the left hand holds the handle grip 20 a sufficient distance between the side 53 and the foot F is obtained. As a result, the user'foot is prevented from being interfered with the wheel 55 while towing the luggage 50. As shown in FIG. 2A, the handle grip 20 is further made pivotable equiangularly about a handle rod 70 (i.e., first sliding tube) with a predetermined angle. Hence, a center of gravity of the luggage 50 is lowered in response to the pivoted handle grip 20. As an end, the user can tow the luggage 50 in a more labor saving manner. It is noted that the handle grip 20 may be extended toward and sufficiently proximate the right side 54 for being adapted to be gripped by the user's right hand in the other embodiment without departing from the scope and spirit of the invention.

Figure 3:
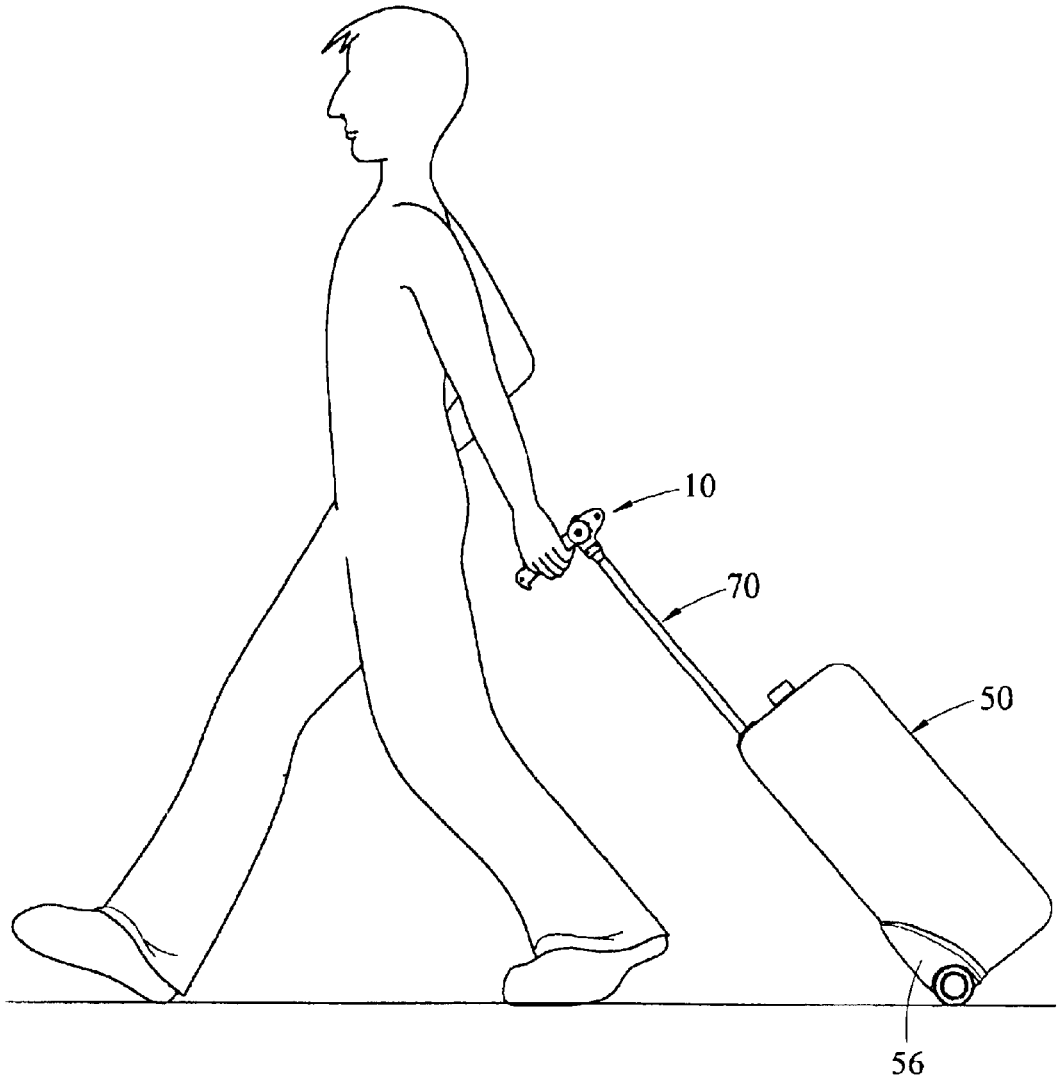
FIG. 3 is a side plan view showing the luggage being towed in another type and the handle grip is pivoted.
Figure 4:
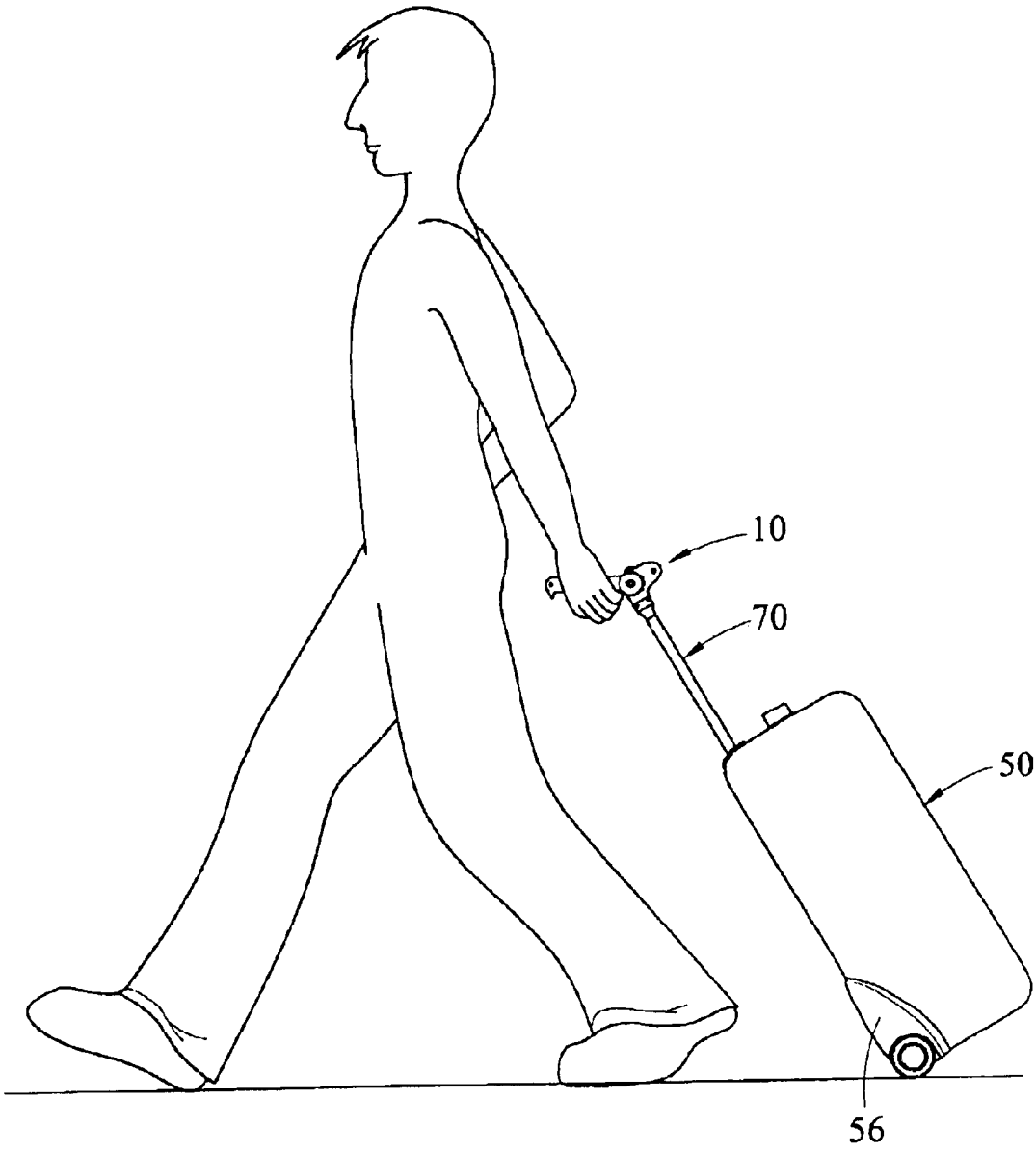
FIG. 4 is a view similar to FIG. 3 where and the handle grip is not pivoted.

In FIG. 3, the handle grip 20 is rotated to an angle of about 90 degrees with respect to the handle rod 70 or the center line C1-C2 between wheels of the luggage 50. At this position, the user can also smoothly tow the luggage 50 by holding the handle grip 20. It means that the orientation of hand holding the handle grip is parallel to a moving direction of the luggage being towed for facilitating an exertion of user's force. As shown in FIG. 4, it is also appreciated that the handle grip 20 can be pivoted. Hence, a center of gravity of the luggage 50 is lowered in response to the pivoted handle grip 20. As an end, the user can tow the luggage 50 in a more labor saving manner.

Note that in the first preferred embodiment of the invention there is also provided a vertical push button (not shown) on a top of the handle assembly 10 being activated for controlling a retraction of the handle assembly 10. Such vertical push button may be implemented as a well known locking device. Thus a detailed description thereof is omitted herein for the sake of brevity.

Referring to FIGS. 5 to 12, there is shown a second preferred embodiment of handle assembly 10 according to the invention. The differences between the first and the second embodiments are detailed as follows. The handle grip is made equiangular pivotal about the plane 100 of the handle rod 70 as shown in FIG. 1 in the preferred embodiment. In the second preferred embodiment, the handle assembly 10 is configured to pivot prior to locking in the pivoted position. In the embodiment, the handle assembly 10 is disposed within the rear 52. Likewise, the luggage 50 comprises a front 51, a rear 52, two sides 53 and 54, a top 57, a bottom 58, two wheels 55 and 56, at two bottom corners of the rear 52 for moving the luggage, and a single handle rod 70 based retractable handle assembly 10. The handle assembly 10 is extended upward from a center at a joining edge of the top 57 and the rear 52. The handle assembly 10 comprises a handle rod 70 (i.e., first sliding tube) having an upper portion and a lower portion, a pivotal handle grip 20 extended horizontally from the top of the handle rod 70 (i.e., parallel to the center line C1-C2 wheels, the top 57, or the bottom 58) in the normal stand-up position. In operation, the handle grip 20 may be equiangularly pivoted from a first position to one of second, third, and fourth positions on the same plane (i.e., parallel to the top 57 a supporting ground) along a horizontal orientation with a 90 degree difference between any two adjacent positions with respect to a second plane 200 which is perpendicular to the first plane 100. Further, in addition to the above four positions, the handle grip 20 may further be equingularly pivoted from a zero degree position to 15 degree, 30 degree, 45 degree, 60 degree, or 75 degree position along a vertical orientation with respect to the first plane 100 (perpendicular to the second plane 200) and any other equiangular pivoted variations will be applicable. In other words, the handle grip 20 can be pivoted to left, right, front, or rear on the top of the handle assembly 10 with respect to the first plane 100. In response, the handle grip 20 can further be equiangularly pivoted to a any other desired degree, such as 0, 15, 30, 45, 60, or 75 degree along the vertical orientation with respect to the first plane 100. With such variety of angle combinations a number of advantages are obtained. For example, it is a labor saving device because an orientation of the hand holding the handle grip is parallel to a moving direction of user while towing the luggage facilitating an exertion of force. Thus, it is ergonomic. Further, a height of the handle grip is adjustable for being adapted to fit different individuals with various heights by pivoting. As a result, a center of gravity of the luggage is lowered in response to the pivoted handle grip. Moreover, the handle grip may be extended toward and sufficiently proximate the right or left side for being adapted to be gripped by the user's right or left hand. In addition, a sufficient distance between the side and the user foot is obtained, thereby preventing the user's foot from being interfered with the wheel while towing the luggage.

As shown, the handle grip 20 has downward extended hook 211 at a free end for preventing the hand from slipping while holding the handle grip 20 Further, an oval pivot mechanism 30 is formed at the other opposite end of the handle grip 20 for ease of holding the handle grip 20.

Referring to FIGS. 5, 6 and 7 again, components of the handle assembly 10 will now be described as follows. The handle assembly 10 comprises a handle grip 20, a horizontal push button link 23 in the handle grip 20, a vertical push button link 40 in a pivot end of the handle grip 20, a pivot mechanism 30 in the pivot end of the handle grip 20, a sleeve 60 put on a lower end of the pivot mechanism 30, a first spring 49 put on a post having a small square section 45 of the vertical push button link 40, a first sliding tube 70, a second sliding tube 16, a support tube 17, a first locking device 18, and a second locking device 19. Note that the components such as the first sliding tube 70, the second sliding tube 16, the support tube 17, the first locking device 18, and the second locking device 19 and operation of the handle assembly 10 are well known. Thus a detailed description thereof is omitted herein for the sake of brevity.

Figure 5:
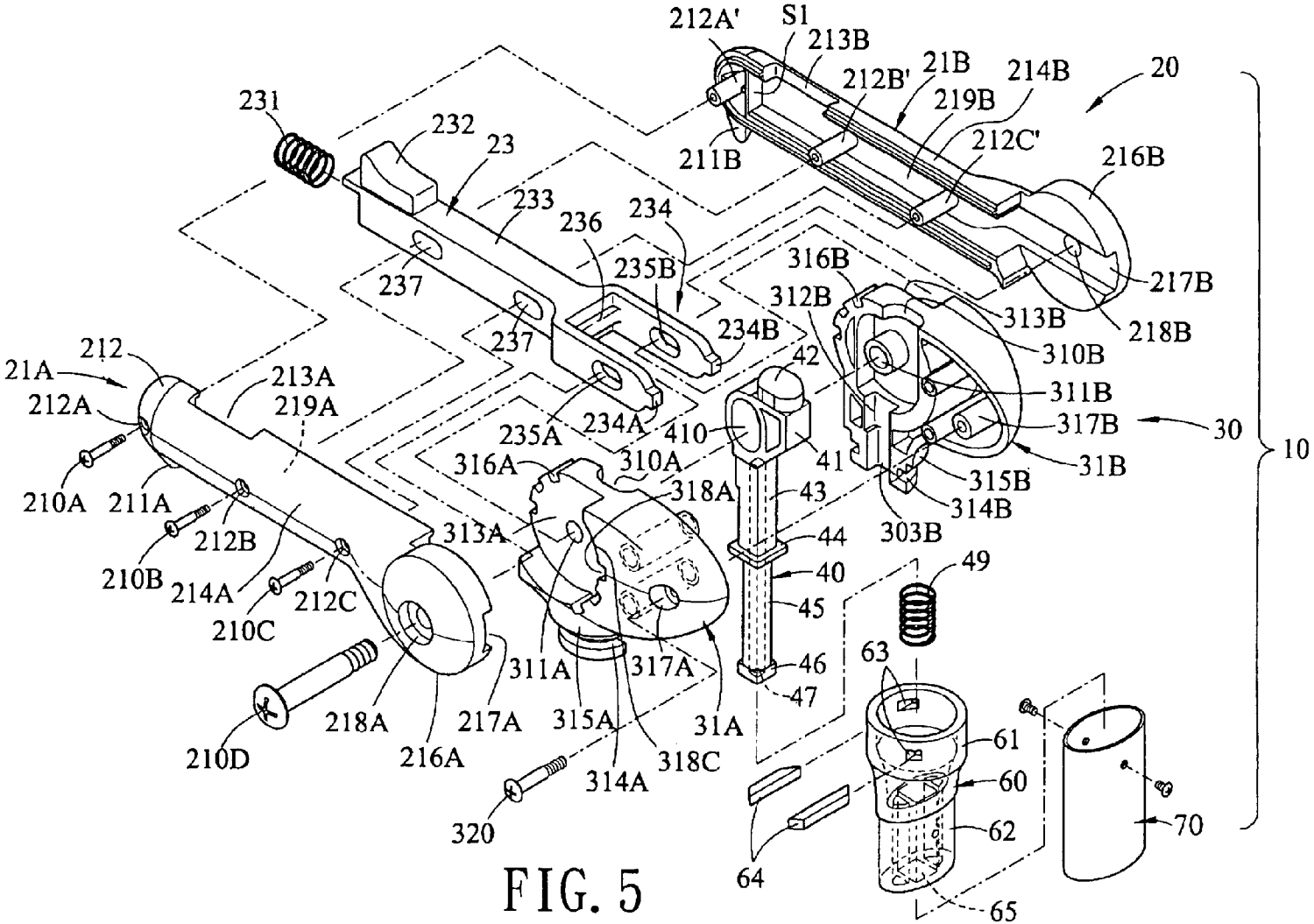
FIG. 5 is an exploded perspective view of a top portion of a handle assembly according to a second preferred embodiment of the invention.

As shown in FIG. 5, the handle grip 20 consists of a first half section 21A and a second half section 21B. The oval pivot mechanism 30 consists of a first half body 31A and a second half body 31B. A hook 211 consisting of a first half section 211A and a second half body 211B is formed at free ends of the first and the second half sections 21A and 21B. At the free end 212 there are provided first and second halves of push button openings 213A and 213B. Both pivot ends 216A and 216B of the first and the second half sections 21A and 21B are projected disc-shaped members. Central grooves 217A and 217B are formed on pivot ends 216A and 216B respectively. The width of each of the grooves 217A and 217B is the same as that of each of communicating channels 219A and 219B in the first and second half sections 21A and 21B respectively Holes 218A and 218B are formed at centers of the pivot ends 216A and 216B respectively. On the channel 219A there are provided first, second, and third holes 212A, 212B and 212C. Correspondingly, on the channel 219B there are provided first, second, and third inner threaded bars 212A', 212B' and 212C'. A plate S1 is formed adjacent the push button opening 213, the first hole 212A, and the first inner threaded bar 212A'.

A push button 232 and a bifurcation member 234 are formed at a free and the other ends of the horizontal push button link 23 respectively. The bifurcation member 234 comprises two branches each having an end projection 234A or 234B. Each of the branches further comprises an elongate opening 235A or 235B. A ridge 236 is formed at a joint of the branches. Two elongate openings 237 are formed on a link body 233 corresponding to the inner threaded bars 212B' and 212C' respectively. A second spring 231 is put on the other side of the push button 232 for urging against the horizontal push button link 23.

The vertical push button link 40 comprises a push button seat 41, a push button member 42 on a top of the push button seat 41, a passage 410 in the push button seat 41 in communication with the holes 218A and 218B of the pivot end of the handle grip 20, a post having large square section 43 extended downward from the passage 410, a large peripheral flange 44 in the intermediate portion having a width larger than that of the post having large square section 43, the post further having a small square section 45 extended downward from the large peripheral flange 44, a small peripheral flange 46 at the bottom of the post having small square section 45, a bore 47 extended upward from the bottom of the small peripheral flange 46 to a top of the post having large square section 43, and the first spring 49 put on the post having small square section 45.

The pivot mechanism 30 clamps the vertical push button link 40 and consists of first and second half bodies 31A and 31B each having a toothed section 313A or 313B having a plurality of first teeth 316A or 316B along an outer edge. On an inner side of a cutout portion 318C of the half bodies 31A and 31B, there are provided a plurality of second teeth 318A or 318B (not shown). A first half tunnel 310A and a second half tunnel 310B are formed on the first and the second half bodies 31A and 31B respectively. Together they can clamp the vertical push button link 40. Inner threaded bars 311A and 311B are formed at lower parts of the half tunnels 310A and 310B respectively. A boss 315 consisting of portions 315A and 315B is formed below a tunnel 310. A large square channel 312 consisting of portions 312A (not shown) and 312B is formed in the boss 315. A small square channel 303 consisting of portions 303A (not shown) and 303B is formed in the lower part of the boss 315. A peripheral trough 314 consisting of portions 314A and 314B is formed around the boss 315 at the lower part of the pivot mechanism 30. Apertures 317A and 317B are formed at both ends of the tunnel 310 on the first and the second half bodies 31A and 31B of the pivot mechanism 30 respectively. A screw 320 is used to fasten the first and the second half bodies 31A and 31B of the pivot mechanism 30 together.

The sleeve 60 is put on the boss 315 of the pivot mechanism 30 and comprises a large diameter section 61 put on the boss 315 and a small diameter section 62 extended from a bottom of the large diameter section 61. Two opposite apertures 63 are formed on the periphery of the large diameter section 61. Two pins 64 are inserted through the apertures 63 to fasten the peripheral trough 314 around the boss 315 at the lower part of the pivot mechanism 30. A recess 65 having a square section is formed within the small diameter section 62 of the sleeve 60. The recess 65 has a width slightly larger than that of the post having small square section 45 at the lower part of the vertical push button link 40 for receiving the post having small square section 45. Also, a section of the recess 65 is the same in size as that of the small square channel 313 of the pivot mechanism 30 and in communication therewith.

In assembly, first cling the passage 410 of the vertical push button link 40 onto the inner threaded bar 311B of the second half body 31B with the push button member 42 projected above the tunnel 310 of the pivot mechanism 30. Then clamp the vertical push button link 40 by means of the first half body 31A prior to engaging with the bifurcation member 234 of the horizontal push button link 23. Thus, the horizontal push button link 23 and the first and the second half bodies 31A and 31B of the pivot mechanism 30 are engaged together with the passage 410, the inner threaded bars 311A, 311B, and the elongate openings 235A, 235B of the bifurcation member 234 aligned. At this position, the ridge 236 is engaged with one tooth of the first teeth 316 (consisting of portions 316A and 316B). Also, the end projections 234A and 234B of the bifurcation member 234 are engaged with the second teeth 318A and 318B of the pivot mechanism 30 respectively. Next, put the second spring 231 onto the free end of the horizontal push button link 23 for engaging the horizontal push button link 23 with the pivot mechanism 30 in a stand-up state. As such, the handle grip 20 is equiangularly pivotable to be at an angle such as 90, 105, 120, 135, 150 degrees about the handle rod 70. Further, the post having large square section 43 of the vertical push button link 40 is inserted into the large square channel 312 of the pivot mechanism 30. As an end, the post having large square section 43 can be moved along the large square channel 312 when the push button member 42 is pressed.

Next, align the inner threaded bars 212A', 212B' and 212C' with the holes 212A, 212B and 212C respectively. Also, insert the inner threaded bars 212B' and 212C' into the elongate openings 237 of the horizontal push button link 23 respectively. Then drive fasteners (e.g., screws) 210A, 210B and 210C through the inner threaded bars 212A', 212B' and 212C'0 and the holes 212A, 212B and 212C respectively for securing the half bodies 21A, 21B and the horizontal push button link 23 together. Further, drive a large screw 210D through the hole 218A of the first half section 21A of the handle grip 20 the first elongate opening 235A of the horizontal push button link 23, the inner threaded bar 311A of the first half body 31A of the pivot mechanism 30, the passage 410, the inner threaded bar 311B of the second half body 31B of the pivot mechanism 30, the second elongate opening 235B of the horizontal push button link 23, and the hole 218B of the second half section 21B of the handle grip 20 for securing above components together.

Note that each of the large square channel 312, the small square channel 303, the post having large square section 43, the large peripheral flange 44, the post having small square section 45, and the small peripheral flange 46 has a square section. As such, the handle grip 20 is adapted to equiangularly rotate 90 degrees per operation. Likewise, the handle grip 20 is adapted to equiangularly rotate 45 degrees per operation if all of them are octagons. Alternatively, they are adapted to equiangularly rotate 30 degrees per operation if all of them are ones having twelve equal sides. In view of above, these components can be formed to have any other shapes if desired.

Figure 6:
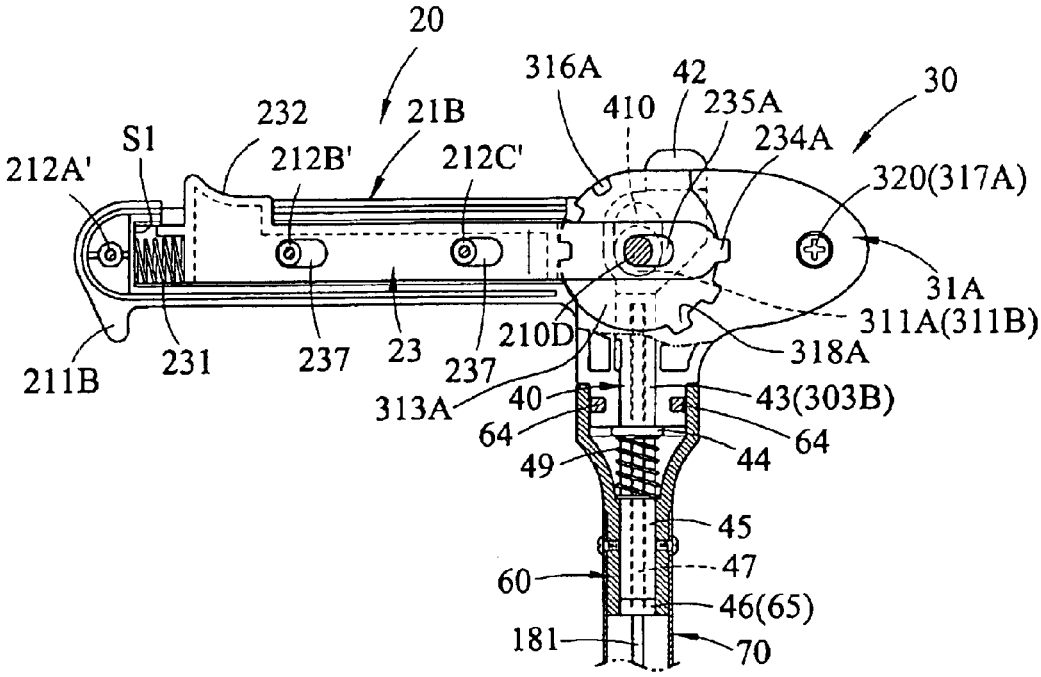
FIG. 6 is a cross-sectional view of the top of the assembled handle assembly of FIG. 5.
Figure 7:
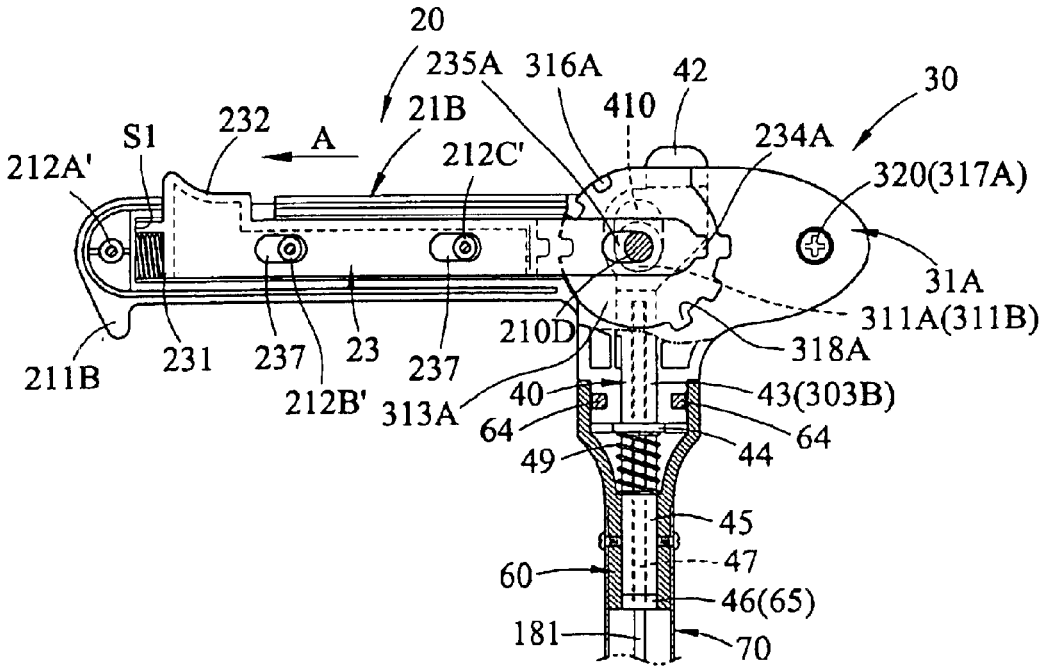
FIG. 7 is a view similar to FIG. 6 where a horizontal push button has been pressed to shift to left.

Referring to FIGS. 6 and 7, in an unused state the free end of the handle grip 20 is urged by the second spring 231 for engaging the ridge 236 and the end projections 234A, 234B with the first teeth 316 and the second teeth 318 respectively in a horizontal orientation, i.e., extended horizontally toward the side of the luggage. Also, in a state that the vertical push button link 40 is not activated the small peripheral flange 46 is received in the recess 65. Thus, the handle grip 20 is positioned at the horizontal orientation.

Figure 11:
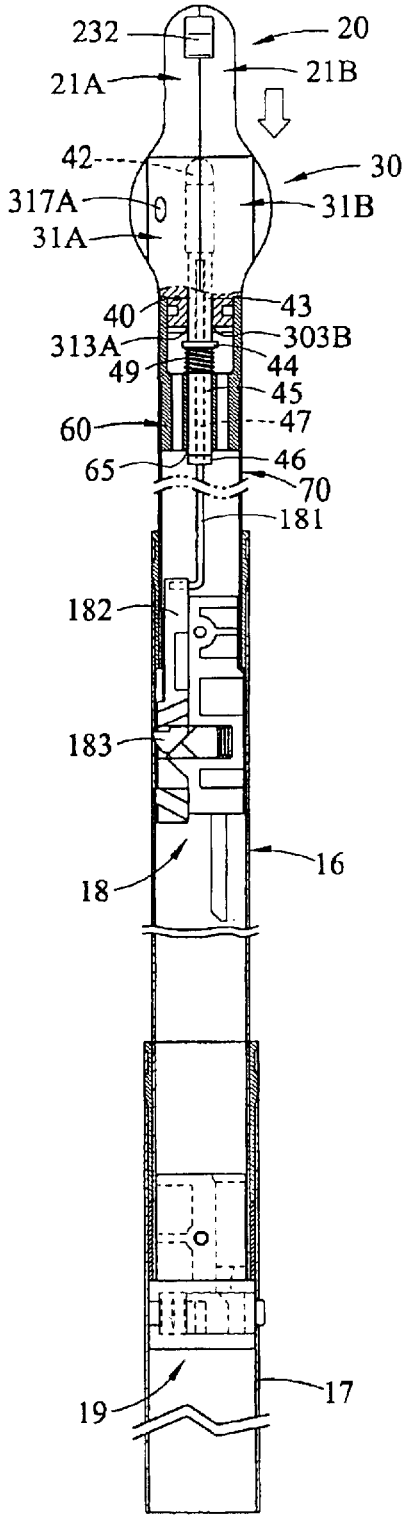
FIG. 11 is a view similar to FIG. 10 where the push button is being pressed and the handle assembly is in an unlocked position.
Figure 12:
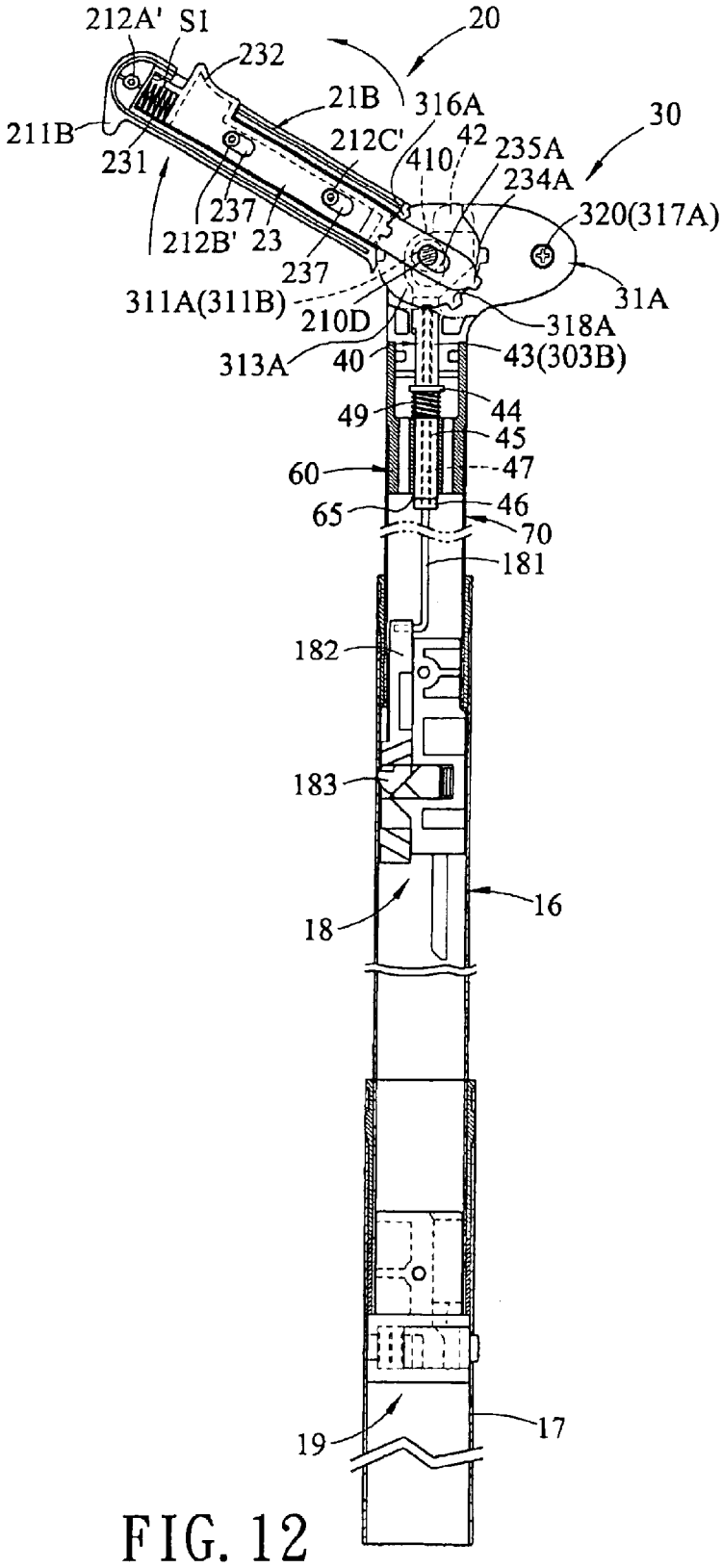
FIG. 12 is another view of FIG. 11 showing handle grip being pivoted.

Referring to FIG. 11, as the push button member 42 is pressed a spring depressible first locking pin 183 is retracted. Thus, the first sliding tube 70 is allowed to pull upward a desired distance until being positioned. At this position, the small peripheral flange 46 at the bottom of the vertical push button link 40 is moved to project from the bottom of the recess 65 of the sleeve 60 as a result of pressing as shown in FIGS. 11 and 12. Further, the handle grip 20 is permitted to pivot to a desired orientation prior to releasing the push button member 42. In response, the vertical push button link 40 moves upward a predetermined distance by the expansion of the first spring 49 prior to positioning. Further, the spring depressible first locking pin 183 is inserted into one of a plurality of apertures on the second sliding tube 16 in a locked position (see FIG. 10). Thus, it is possible of pivoting the handle grip 20 of the handle assembly 10 to manipulate the luggage.

Figure 8:
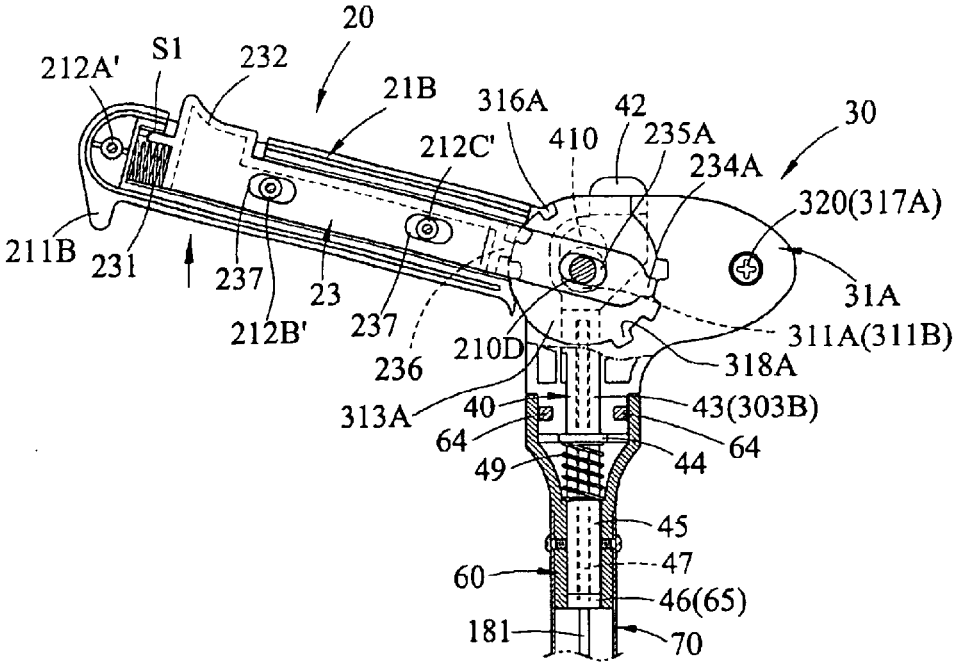
FIG. 8 is a view similar to FIG. 7 showing the handle grip being pivoted.
Figure 9:
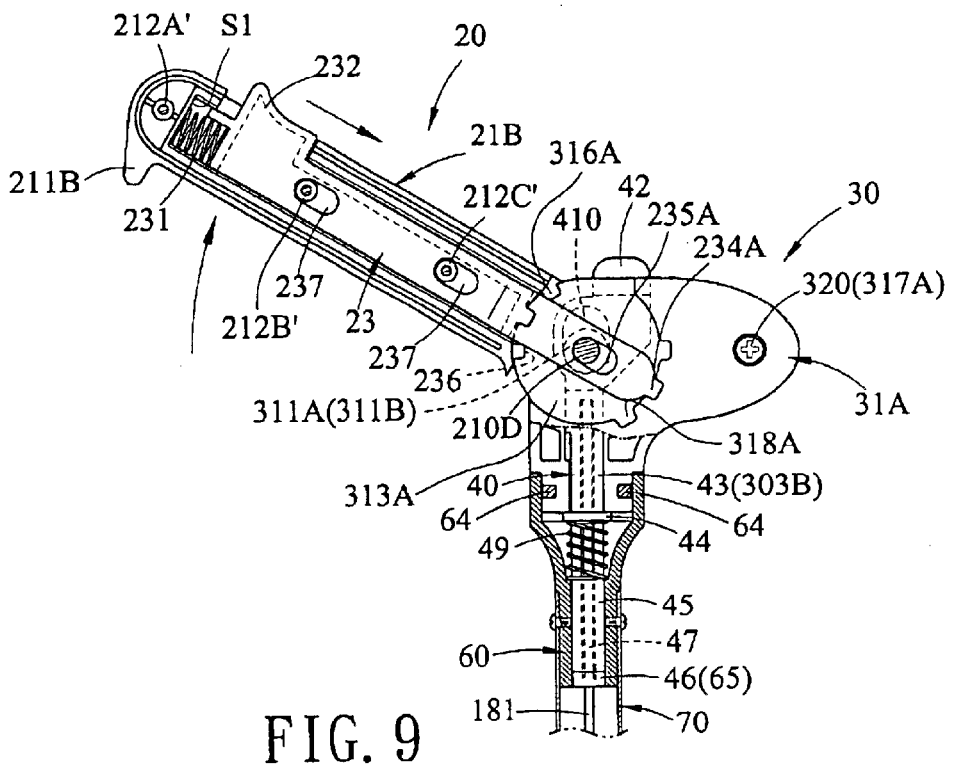
FIG. 9 is a view similar to FIG. 7 showing the handle grip has been locked after pivoting.
Figure 10:
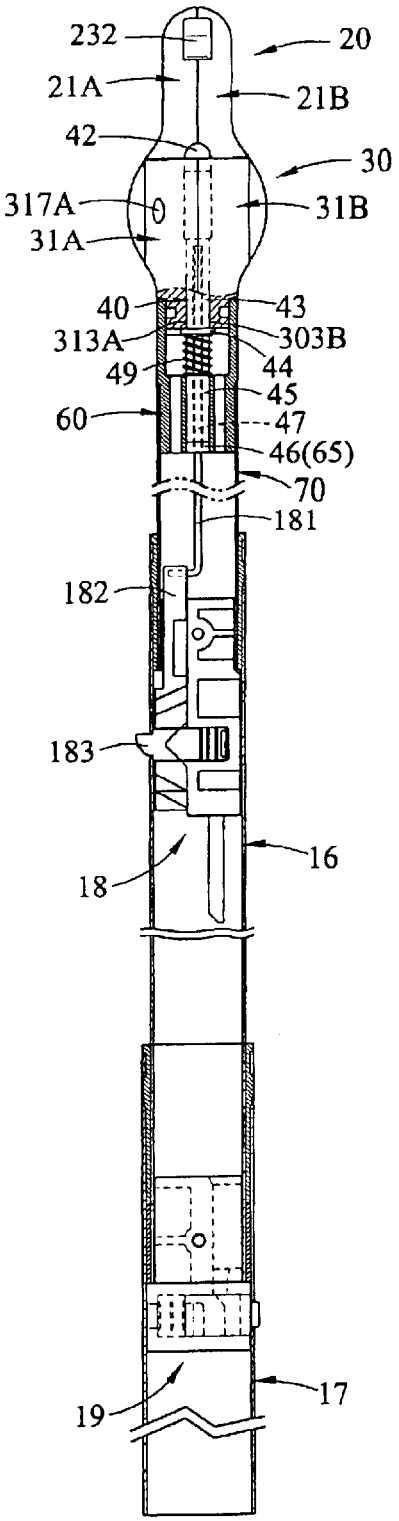
FIG. 10 is a cross-sectional view of FIG. 5A handle assembly in a locked position.

In a case that a pivoting of the handle grip 20 about the horizontal orientation is desired user can push the push button 232 outward as indicated by arrow A. In response, the second spring 231 is compressed as shown in FIG. 7. Thus, the handle grip 20 is pushed toward the free end thereof for disengaging the ridge 236 and the end projections 234A, 234B of the handle grip 20 from the first teeth 316 and the second teeth 318 of the pivot mechanism 30 respectively. At this position, the handle grip 20 is allowed to pivot (FIG. 8). The ridge 236 and the end projections 234A, 234B are engaged with the first teeth 316 and the second teeth 318 of the pivot mechanism 30 again for positioning after the handle grip 20 has been pivoted to a desired position (FIG. 9).

Note that the number of the teeth on the handle grip 20 and that on the pivot mechanism 30 may be equal or not equal. Further, such number may be varied depending on the desired times of pivoting.

As shown in FIG. 12, press the push button member 42 again for pulling the handle rod to a desired position prior to locking, as stated above. Also, the small peripheral flange 46 at the bottom of the vertical push button link 40 is moved to disengage from the bottom of the recess 65 as a result of pressing. Thus, both the handle grip 20 and the pivot mechanism 30 are permitted to pivot in the sleeve 60 until a desired position is reached. Then the push button member 42 is moved upward to cause the small peripheral flange 46 to move to be locked in the recess 65 of the sleeve 60 again.

Figure 5A:
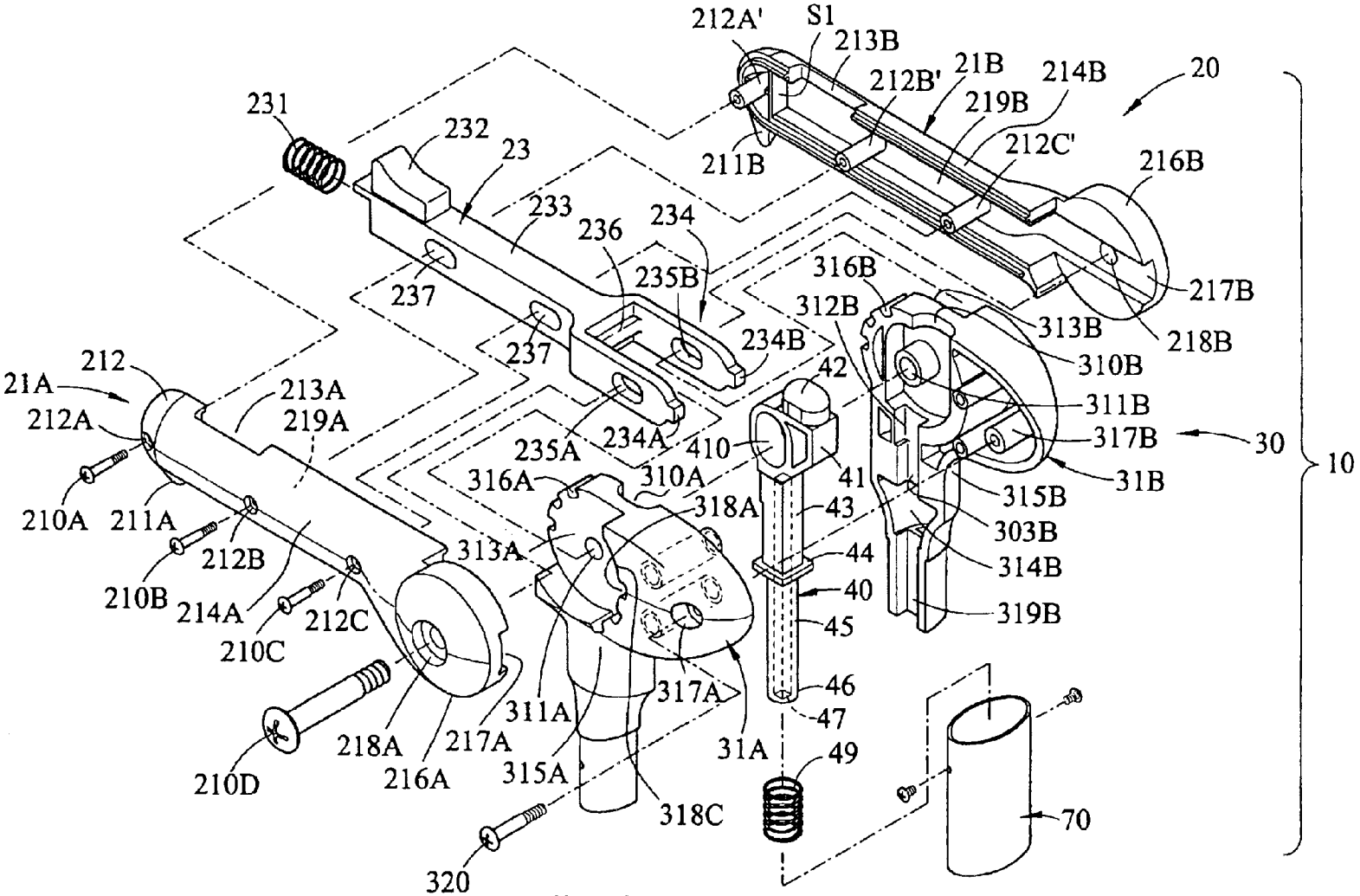
FIG. 5A is an exploded view of a top portion of a handle assembly according to a third preferred embodiment of the invention.

Referring to FIG. 5A, there is shown a third preferred embodiment of the handle assembly 10 according to the invention. The differences between the second and the third embodiments are detailed below. In the embodiment, the handle grip is not pivotal. To the contrary it is only permitted to retract or extend lengthwise in the positioned state. As such, the pivot mechanism 30 and the sleeve 60 under the pivot mechanism 30 in the second embodiment are formed integrally as the boss 315 of the third embodiment. The boss 315 is further threadedly secured to the first sliding tube 70. A large square channel 312 is formed in the boss 315. A first small square channel 313 is formed in the lower part of the boss 315. A large chamber 314 is formed around the boss 315. A second small square channel 319 is formed in the lower part of the boss 315. Hence, the large peripheral flange 44 of the vertical push button link 40 is received in the large chamber 314. Also, a bottom 46 of the vertical push button link 40 is slidable along the second small square channel 319 in the boss 315 for achieving the purpose of retracting or extending the handle rod. A detailed description of other components is omitted herein since they are mirror images of the same in the second embodiment.

Figure 13:
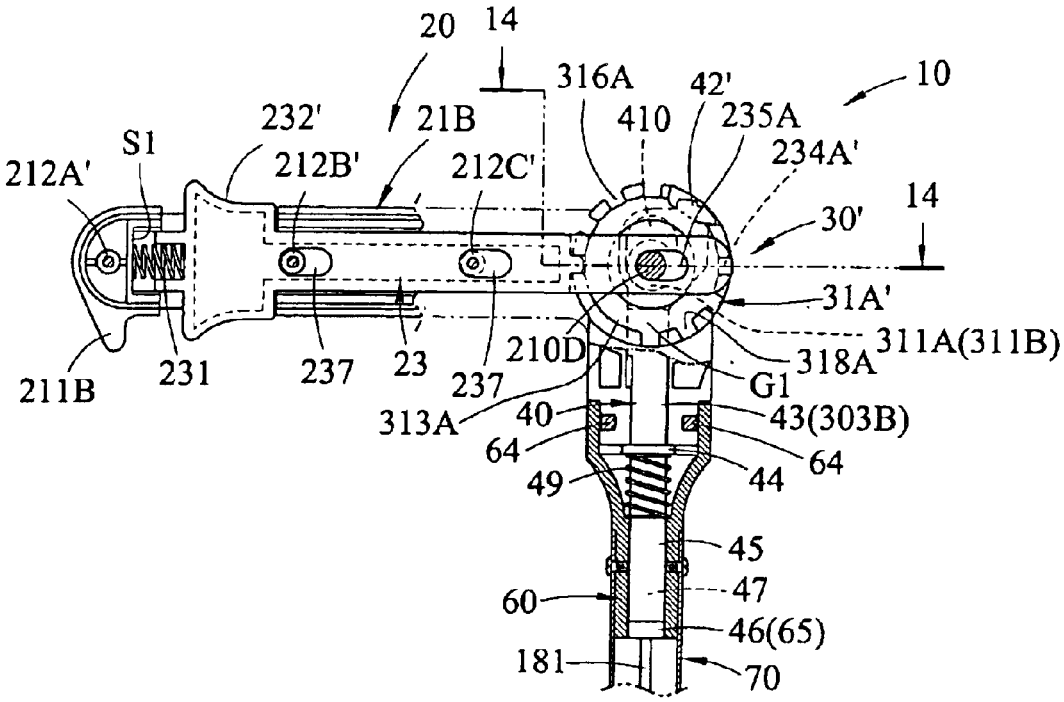
FIG. 13 is a cross-sectional view of a top of the handle assembly according to a fourth preferred embodiment of the invention.
Figure 14:
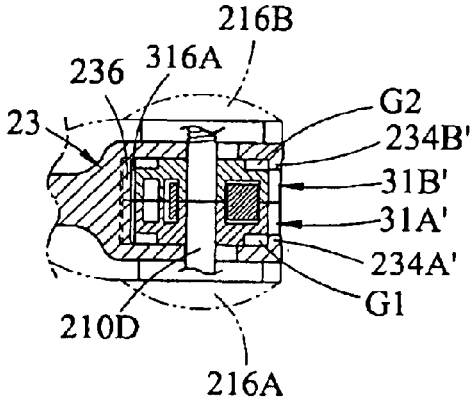
FIG. 14 is a cross-sectional view taken along line 14—14 of FIG. 13.
Figure 15:
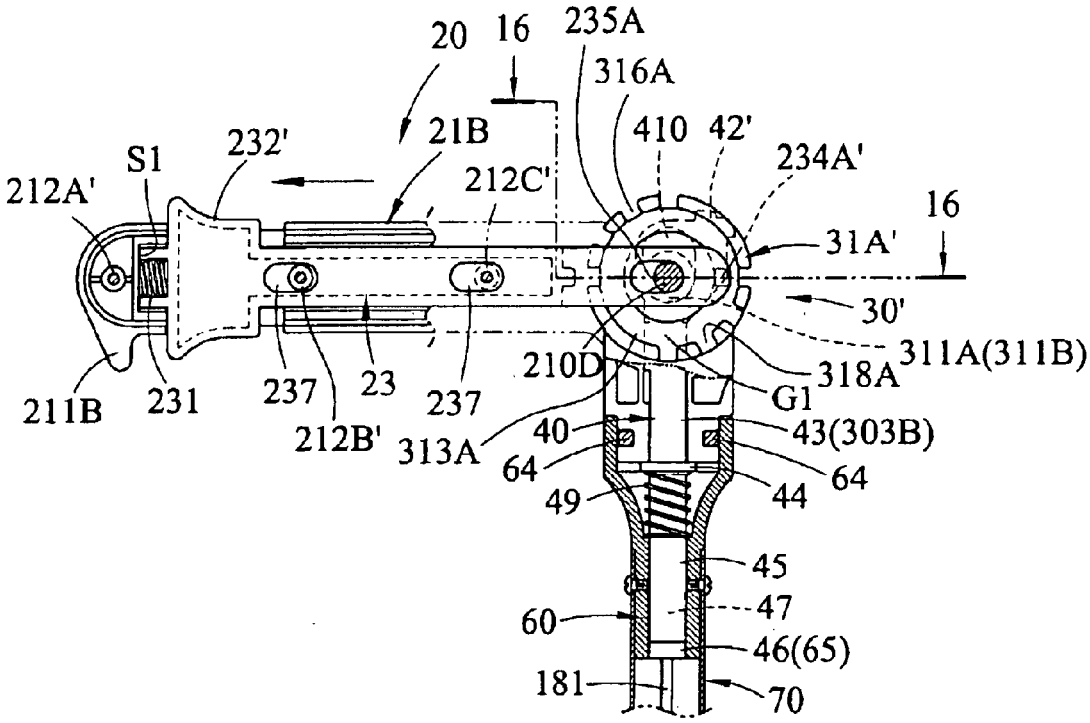
FIG. 15 is a view similar to FIG. 13 where the horizontal push button has been pressed to shift to left.
Figure 16:
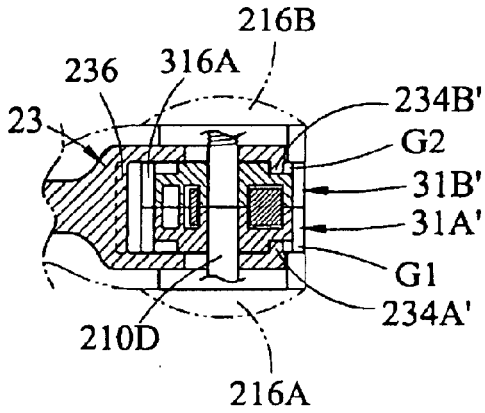
FIG. 16 is a cross-sectional view taken along line 16—16 of FIG. 15.
Figure 18:
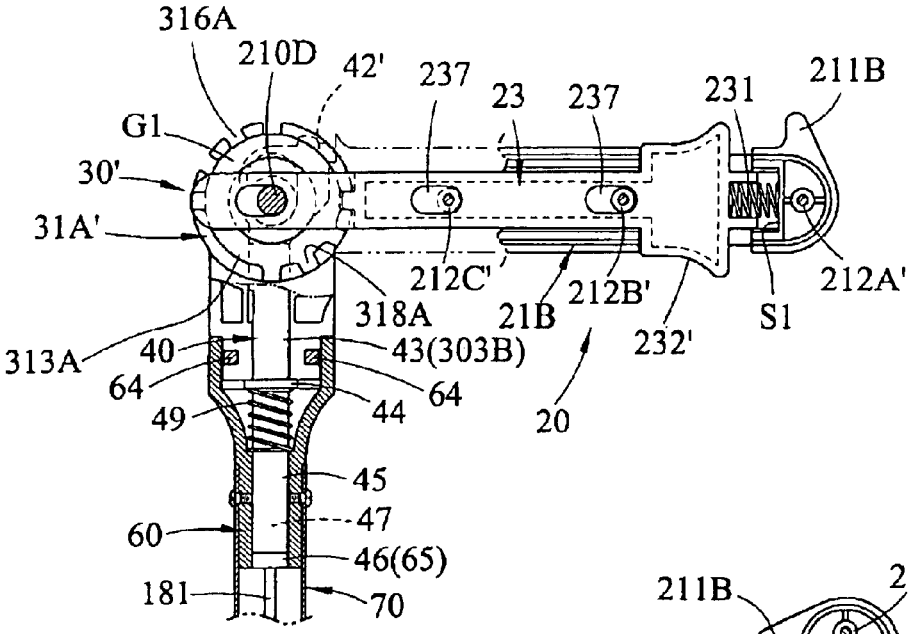
FIG. 18 is a view similar to FIG. 13 showing the handle grip being pivoted to the right and to be perpendicular to the handle rod.
Figure 17:
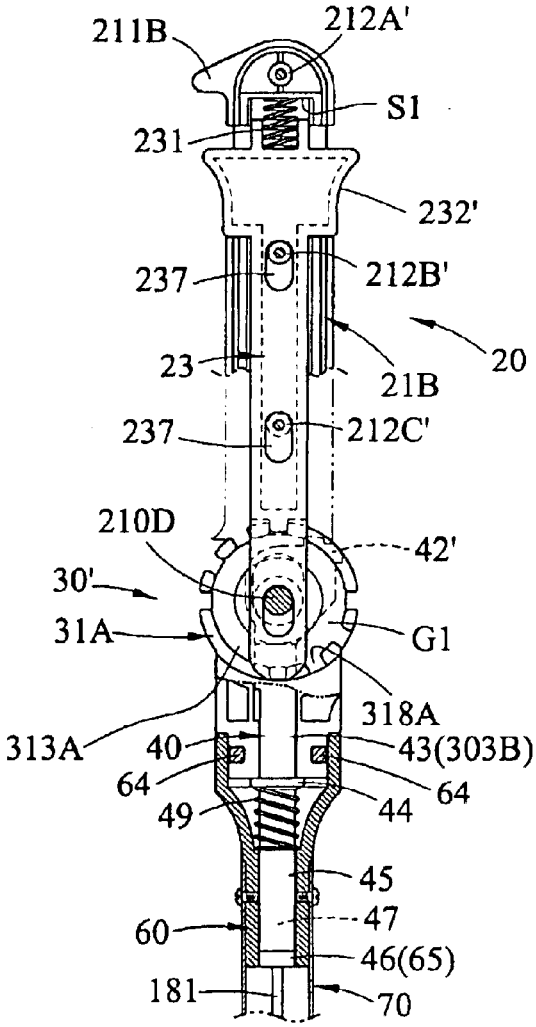
FIG. 17 is a view similar to FIG. 13 showing the handle grip being pivoted to be aligned with the handle rod.
Figure 20:
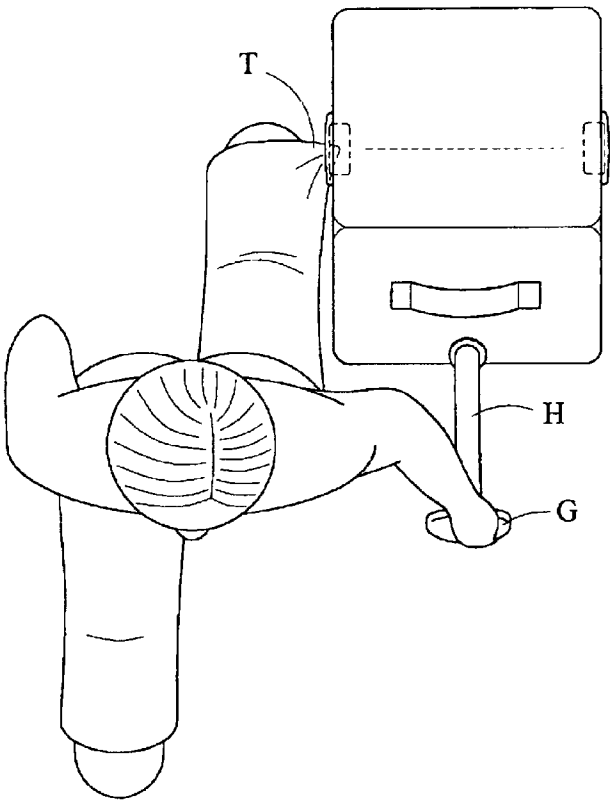
FIG. 20 (PRIOR ART)
FIG. 20 is a top plan view showing the FIG. 19 luggage being towed.
Figure 19:
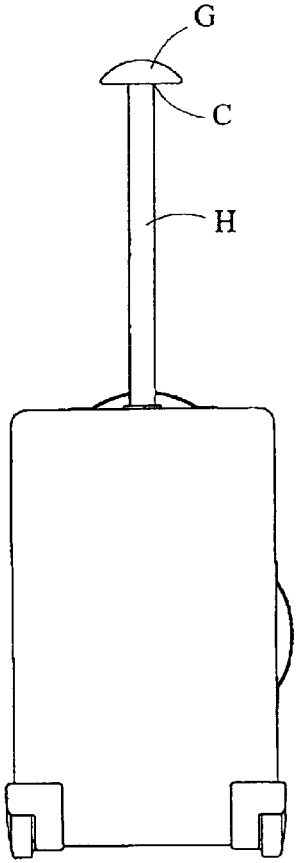
FIG. 19 (PRIOR ART)
FIG. 19 is a rear plan view of a conventional luggage incorporating a handle assembly having a single handle rod.

Referring to FIGS. 13 to 18 there is shown a fourth preferred embodiment of the handle assembly 10 according to the invention. The differences between the second and the third embodiments are detailed below. In the embodiment for the purpose of increasing a pivotal angle range of the handle grip about the top of the handle rod (i.e., from 0 to 180 degrees as shown in FIGS. 13, 17 and 18), the oval pivot mechanism 30 in the second, embodiment is replaced by a rounded pivot mechanism 30'. As shown, the horizontal push button 232' is designed to be one having symmetrical upper and lower half portions. Peripheral grooves G1, G2 are further disposed on inner peripheries of the ridges 316, 318 respectively. In operating the horizontal push button 232' the ridge 236 of the bifurcation member and the opposite end projections 234A, 234B of the branches of the horizontal push button link 23 are engaged with the peripheral grooves G1, G2 respectively (FIGS. 15 and 16).

Whereby, the handle grip is permitted to equiangularly pivot about the top of the handle rod in the first plane 100. It means that the equiangularly pivoted angle range of the handle grip can be varied with respect to the first plane 100 from 0 to 180 degrees. Hence, as user holds the handle grip he/she can select a desired position parallel to the second plane 200 while holding for completely exerting force on the handle grip. As such, a center of gravity of the luggage is lowered in response to the pivoted handle grip. As an end, the user can tow the luggage in a more labor saving manner.

Moreover, as shown in FIGS. 13 to 18, the handle grip can also be equiangularly pivoted from 0 to 180 degrees horizontally with respect to the second plane perpendicular to the first plane 100.

As stated above, the characteristics of this invention are that the handle grip can be equiangularly pivoted with respect to the second plane 200 from 0 to 180 degrees. Also, it can extend in a direction perpendicular to the handle rod. Thus, the handle grip can be operated in either a fixed direction or pivoted to a desired angle. This is a design tailored to the needs of consumers (i.e., highly adaptable). In brief, the handle grip is extended from the center at a joining edge of the top and the rear of luggage proximate the side. Thus, there is no interference of user's body with wheel while towing luggage. Further, the handle grip is pivoted to a desired angle for ease of holding the handle grip. As such, the center of gravity of the luggage is lowered while being towed. Moreover, user can select a desired comfortable position to hold the handle grip since the handle grip is allowed to pivot to a desired angle. As shown in FIGS. 3 and 4, user can hold the handle grip in a direction parallel or perpendicular to a moving direction of user while towing the luggage as desired.

While the invention herein disclosed has been described by means of specific embodiments, numerous modifications and variations could be made thereto by those skilled in the art without departing from the scope and spirit of the invention set forth in the claims.

What is claimed is:

1. A retractable handle assembly of a luggage having wheels at both rear corners for moving the luggage, the handle assembly comprising:

a single handle rod vertically extended upward from a center at a joining edge of a top and a rear of the luggage and having an upper portion and a lower portion connected to the rear of the luggage; and a handle grip pivotally connected at an end thereof to the handle rod and pivotable in a predetermined equiangular range in a first plane perpendicular with the handle rod;

wherein by orientation of a hand holding the handle grip is parallel to a moving direction of the luggage being towed for facilitating an exertion of user's force thereon, thereby lowering a center of gravity of the luggage for saving labor, wherein the handle grip is equiangularly pivotably extended from the top of the handle rod with respect to the first plane, wherein the handle grip is equiangularly pivotably extended with respect to a second plane, which is perpendicular to the first plane, wherein the handle grip further comprises a pivot mechanism, a horizontal push button link and a vertical push button link controlling the pivot mechanism, a circular tunnel above the pivot mechanism, a multi-sided post below the circular tunnel, and the pivot mechanism comprises an upper large square channel, a lower small square channel, and a peripheral trough around the small square channel.

2. The handle assembly of claim 1, wherein the handle grip consists of a first half section and a second half section, the first and second half sections having pivot ends, the pivot mechanism consists of a first half body and a second half body, a hook at free ends of the first and the second half sections of the handle grip, a push button opening at the free ends, each of the pivot ends of the first and the second half sections has a projected disc-shaped member, and further comprising two central grooves on the pivot ends of the first and the second half sections wherein a width of each of the grooves is the same as that of each of two communicating channels in the first and the second half sections, two second holes at centers of the pivot ends of the first and the second half sections respectively, first, second, and third through holes on a first of the two communicating channels, first, second, and third inner threaded bars on a second of the two communicating channels corresponding to the first, the second, and the third through holes, and a plate adjacent the push button opening, the first through hole, and the first inner threaded bar.

3. A retractable handle assembly of a luggage having wheels at both rear corners for moving the luggage, the handle assembly comprising:

a single handle rod vertically extended upward from a center at a joining edge of a top and a rear of the luggage and having an upper portion and a lower portion connected to the rear of the luggage; and a handle grip pivotally connected at an end thereof to the handle rod and pivotable in a predetermined equiangular range in a first plane perpendicular with the handle rod;

wherein by orientation of a hand holding the handle grip is parallel to a moving direction of the luggage being towed for facilitating an exertion of user's force thereon, thereby lowering a center of gravity of the luggage for saving labor, wherein the handle assembly further comprises a horizontal push button link in the handle grip, a vertical push button link in a pivot end of the handle grip, a pivot mechanism in the pivot end of the handle grip controlled by the horizontal push button link and the vertical push button link, a sleeve on a lower end of the pivot mechanism, a first spring on a post having a small square section of the vertical push button link, a first sliding tube, a second sliding tube, a support tube, a first locking device, and a second locking device, wherein the vertical push button link in the pivot mechanism comprises a push button seat, a push button member on a top of the push button seat, a passage in the push button seat in communication with first holes at the pivot mechanism, a post having a large square section extended downward from the passage, a large peripheral flange in an intermediate portion, a post having a small square section extended downward from the large peripheral flange, a small peripheral flange at a bottom of the post having a small square section, a bore extended upward from a bottom of the small peripheral flange to a top of the post having a large square section, and the first spring put on the post having a small square section.

4. A retractable handle assembly of a luggage having wheels at both rear corners for moving the luggage, the handle assembly comprising:

a single handle rod vertically extended upward from a center at a joining edge of a top and a rear of the luggage and having an upper portion and a lower portion connected to the rear of the luggage; and a handle grip pivotally connected at an end thereof to the handle rod and pivotable in a predetermined equiangular range in a first plane perpendicular with the handle rod;

wherein by orientation of a hand holding the handle grip is parallel to a moving direction of the luggage being towed for facilitating an exertion of user's force thereon, thereby lowering a center of gravity of the luggage for saving labor, wherein the handle assembly further comprises a horizontal push button link in the handle grip, a vertical push button link in a pivot end of the handle grip, a pivot mechanism in the pivot end of the handle grip controlled by the horizontal push button link and the vertical push button link, a sleeve on a lower end of the pivot mechanism, a first spring on a post having a small square section of the vertical push button link, a first sliding tube, a second sliding tube, a support tube, a first locking device, and a second locking device, wherein the horizontal push button link in the pivot mechanism comprises a push button at a free end and a bifurcation member at the other end including two branches each having an end projection and a first elongate opening, a ridge at a joint of the branches, and a link body having two second elongate openings corresponding to inner threaded bars of the handle grip respectively.

5. A retractable handle assembly of a luggage having wheels at both rear corners for moving the luggage, the handle assembly comprising:

a single handle rod vertically extended upward from a center at a joining edge of a too and a rear of the luggage and having an upper portion and a lower portion connected to the rear of the luggage; and a handle grip pivotally connected at an end thereof to the handle rod and pivotable in a predetermined equiangular range in a first plane perpendicular with the handle rod;

wherein by orientation of a hand holding the handle grip is parallel to a moving direction of the luggage being towed for facilitating an exertion of user's force thereon, thereby lowering a center of gravity of the luggage for saving labor, wherein the handle grip is equiangularly pivotably extended from the top of the handle rod with respect to the first plane, wherein the handle grip is equiangularly pivotably extended with respect to a second plane, which is perpendicular to the first plane, wherein the handle assembly further comprises a horizontal push button link in the handle grip, a vertical push button link in a pivot end of the handle grip, a pivot mechanism in the pivot end of the handle grip, a sleeve on a lower end of the pivot mechanism, a first spring on a post having a small square section of the vertical push button link, a first sliding tube, a second sliding tube, a support tube, a first locking device, and a second locking device, wherein the sleeve comprises a large diameter section on a boss below the circular tunnel, a small diameter section extended from a bottom of the large diameter section, two opposite first apertures on a periphery of the large diameter section, two pins inserted through the first apertures to fasten the peripheral trough around the boss at the pivot mechanism, and a recess with a square section within the small diameter section, the recess having a width larger than that of the post having a small square section for receiving the post having a small square section, the section of the recess being the same in size as that of the small square channel and in communication therewith.

6. The handle assembly of claim 5, wherein the pivot mechanism consists of a first half body and a second half body each having a toothed section having a plurality of first teeth along an outer edge, a plurality of second teeth on an inner side of the toothed section, a tunnel consisting of a first half tunnel and a second half tunnel on the first and the second half bodies respectively together with the vertical push button link secured therein, two inner threaded bars at lower parts of the half tunnels respectively, the boss below the tunnel, the peripheral trough around the boss, two second apertures at both ends of the tunnel on the first and the second half bodies respectively, and a screw for fastening the first and the second half bodies together.

7. A retractable handle assembly of a luggage having wheels at both rear corners for moving the luggage, the handle assembly comprising:

a single handle rod extended upward from a center at a joining edge of a top and a rear of the luggage and having an upper portion and a lower portion connected to the rear; and a pivotal handle grip pivotally connected at an end thereof to the handle rod and pivotable in a plane parallel with the handle rod wherein a pivot equiangular position of the handle grip is variable with respect to the plane parallel to the handle rod is from 0 degree to 180 degrees;

whereby an orientation of a hand holding the handle grip is parallel to the first plane direction of the luggage being towed for facilitating an exertion of force thereon, thereby lowering a center of gravity of the luggage for saving labor, the handle grip having a free end and a pivot end, the handle grip including a first half section and a second half section;

a horizontal push button link in the handle grip and including a push button at a free end, a bifurcation member at the other end including two branches having two end projections and a ridge at a joint of the branches, and a first spring for urging the push button to return to its original uncompressed position;

a rounded pivot mechanism at the pivot end of the handle grip, including a first half body and a second half body, and having a toothed section along a first outer edge having a plurality of first teeth and along a second outer edge having a pair of a plurality of second teeth;

a vertical push button link secured between the first and the second half bodies of the rounded pivot mechanism and including a top push button member, a passage below the push button member, a post having a large square section extended downward from the passage, a large peripheral flange in an intermediate portion of large square section, a post having a small square section extended downward from the large peripheral flange, a small peripheral flange at a bottom of the post having a small square section, and a second spring put on the post having a small square section;

a sleeve put on a lower end of the rounded pivot mechanism;

a first sliding tube under the sleeve;

a second sliding tube slidingly sleeved on the first sliding tube;

a support tube with the second sliding tube slidingly received therein;

a first locking device under the first sliding tube; and a second locking device under the second sliding tube;

wherein in response to an outward pushing of the horizontal push button link, the ridge of the bifurcation member is disengaged from the first teeth and the end projections of the branches of the horizontal push button link are disengaged from the second teeth, whereby the handle grip is operative to pivot from a first position to a second position on a first plane with a pivot angle from 0 degree to 180 degrees.

8. The handle assembly of claim 7, wherein the push button member is pressed to pull the handle rod prior to locking so that the small peripheral flange at the bottom of the vertical push button link is moved to disengage from a bottom of a recess of the post having a small square section, the handle grip is operative to horizontally pivot from the first position to the second position on a second plane perpendicular to the plane parallel with the handle rod, and the pivot angle of the handle grip is from 0 degree to 180 degrees.

* * * * *